US009127551B2

(12) United States Patent
Narcus et al.

(10) Patent No.: US 9,127,551 B2
(45) Date of Patent: Sep. 8, 2015

(54) TURBINE COMBUSTION SYSTEM COOLING SCOOP

(75) Inventors: Andrew R. Narcus, Loxahatchee, FL (US); Matthew Gent, Port St. Lucie, FL (US); Neal Therrien, Stuart, FL (US)

(73) Assignee: Siemens Energy, Inc., Orlando, FL (US)

( * ) Notice: Subject to any disclaimer, the term of this patent is extended or adjusted under 35 U.S.C. 154(b) by 921 days.

(21) Appl. No.: 13/241,391

(22) Filed: Sep. 23, 2011

(65) Prior Publication Data

US 2012/0247112 A1 Oct. 4, 2012

Related U.S. Application Data

(60) Provisional application No. 61/468,678, filed on Mar. 29, 2011.

(51) Int. Cl.
*F01D 9/02* (2006.01)
*F23R 3/00* (2006.01)

(52) U.S. Cl.
CPC ..... *F01D 9/023* (2013.01); *F05B 2250/241* (2013.01); *F05B 2250/292* (2013.01); *F05B 2260/201* (2013.01); *F05D 2250/241* (2013.01); *F05D 2250/292* (2013.01); *F05D 2260/201* (2013.01); *F23R 3/002* (2013.01)

(58) Field of Classification Search
CPC ..... F23R 3/002; F23R 2900/03042; F23R 2900/03043; F23R 2900/03044; F23R 2900/03045; F01D 9/023
USPC ..... 60/39.12–39.19, 39.08–39.11, 60/39.21–39.465, 39.47–39.59, 60/39.6–39.81, 200.1, 201, 227, 39.01, 60/228–269, 224–226.3, 39.821–39.83, 60/722–806, 202–220, 221–223; 137/15.1–15.2; 239/127.1, 127.3, 239/265.11–265.43
See application file for complete search history.

(56) References Cited

U.S. PATENT DOCUMENTS

| | | | | |
|---|---|---|---|---|
| 3,581,492 | A | 6/1971 | Norgren et al. | |
| 4,719,748 | A | 1/1988 | Davis, Jr. et al. | |
| 5,077,969 | A * | 1/1992 | Liang et al. | 60/766 |
| 6,018,950 | A | 2/2000 | Moeller | |
| 6,065,932 | A | 5/2000 | Dodd | |
| 6,494,044 | B1 * | 12/2002 | Bland | 60/772 |
| 6,640,547 | B2 | 11/2003 | Leahy, Jr. | |
| 7,010,921 | B2 | 3/2006 | Intile et al. | |
| 7,137,241 | B2 | 11/2006 | Martling et al. | |
| 7,310,938 | B2 | 12/2007 | Marcum et al. | |
| 7,493,767 | B2 | 2/2009 | Bunker et al. | |

(Continued)

FOREIGN PATENT DOCUMENTS

| | | | |
|---|---|---|---|
| EP | 1795708 | A2 | 6/2007 |
| EP | 2141329 | A2 | 1/2010 |

(Continued)

*Primary Examiner* — Gerald L Sung
*Assistant Examiner* — Thomas Burke

(57) ABSTRACT

A scoop (54) over a coolant inlet hole (48) in an outer wall (40B) of a double-walled tubular structure (40A, 40B) of a gas turbine engine component (26, 28). The scoop redirects a coolant flow (37) into the hole. The leading edge (56, 58) of the scoop has a central projection (56) or tongue that overhangs the coolant inlet hole, and a curved undercut (58) on each side of the tongue between the tongue and a generally C-shaped or generally U-shaped attachment base (53) of the scoop. A partial scoop (62) may be cooperatively positioned with the scoop (54).

1 Claim, 4 Drawing Sheets

(56) References Cited

U.S. PATENT DOCUMENTS

| | | | | |
|---|---|---|---|---|
| 7,607,308 | B2 * | 10/2009 | Kraft et al. | 60/785 |
| 7,827,801 | B2 * | 11/2010 | Dawson et al. | 60/759 |
| 2005/0268615 | A1 * | 12/2005 | Bunker et al. | 60/772 |
| 2007/0180827 | A1 | 8/2007 | Dawson et al. | |
| 2007/0227149 | A1 * | 10/2007 | Biebel et al. | 60/752 |
| 2008/0276619 | A1 | 11/2008 | Chopra et al. | |
| 2009/0145099 | A1 | 6/2009 | Jennings et al. | |
| 2009/0188258 | A1 | 7/2009 | Rizkalla et al. | |
| 2009/0252593 | A1 | 10/2009 | Chila et al. | |
| 2010/0000200 | A1 | 1/2010 | Smith | |

FOREIGN PATENT DOCUMENTS

| | | | |
|---|---|---|---|
| EP | 2246627 | A2 | 3/2010 |
| JP | S63285231 | A | 11/1988 |
| JP | 2000074333 | A | 3/2000 |
| JP | 2002155759 | A | 5/2002 |
| JP | 2005345093 | A | 12/2005 |
| JP | 2007132640 | A | 5/2007 |
| JP | 2007154901 | A | 6/2007 |
| JP | 2008169840 | A | 7/2008 |
| JP | 2010256005 | A | 11/2010 |

* cited by examiner

TURBINE COMBUSTION SYSTEM COOLING SCOOP

This application claims benefit of the Mar. 29, 2011 filing date of U.S. patent application Ser. No. 61/468,678, which is incorporated by reference herein.

FIELD OF THE INVENTION

This invention relates to cooling of gas turbine combustion chambers and transition ducts, and particularly to scoop-assisted impingement cooling.

BACKGROUND OF THE INVENTION

In gas turbine engines, air is compressed at an initial stage then heated in combustion chambers. The resulting hot working gas drives a turbine that performs work, including rotating the air compressor.

In a common industrial gas turbine configuration, a number of combustion chambers may be arranged in a circular array about a shaft or axis of the gas turbine engine in a "can annular" configuration. A respective array of transition ducts connects the outflow of each combustor to the turbine entrance. Each transition duct is a generally tubular walled structure or enclosure that surrounds a hot gas path between a combustion chamber and the turbine. The walls of the combustion chambers and transition ducts are subject to high temperatures from the combusted and combusting gases. These walls are subject to low cycle fatigue, due to their position between other dynamic components, temperature cycling, and other factors. This is a major design consideration for component life cycle.

Combustion chamber walls and transition duct walls may be cooled by open or closed cooling using compressed air from the turbine compressor, by steam, or by other approaches. Various designs of channels are known for passage of cooling fluids in these walls, the interior surfaces of which may be coated with a thermal barrier coating as known in the art.

An approach to cooling a transition duct is exemplified in U.S. Pat. No. 4,719,748. A sleeve over a transition duct is configured to provide impingement jets formed by apertures in the sleeve. U.S. Pat. No. 6,494,044 describes cooling a transition duct by means of a surrounding sleeve perforated with impingement cooling holes. The cooling air enters the holes and impinges on the transition duct inner wall. Air scoops facing into the cooling flow are added to some of the impingement holes to increase the impingement jet velocity. U.S. Patent Application Publication Nos. 2009/0145099 and 2010/0000200 show related scoops for impingement cooling of transition ducts. Notwithstanding these and other approaches, there remains a need to provide more effective cooling of combustors and transition ducts.

BRIEF DESCRIPTION OF THE DRAWINGS

The invention is explained in the following description in view of the drawings that show.

DETAILED DESCRIPTION OF THE INVENTION

Figure 1:
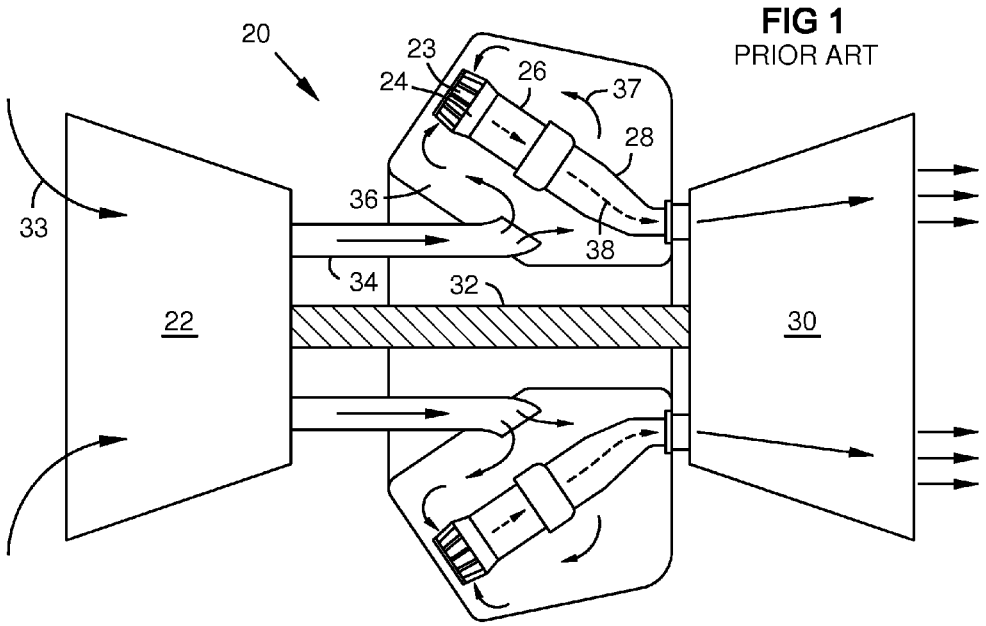
FIG 1 PRIOR ART
FIG. 1 is a schematic view of a prior art gas turbine engine.

FIG. 1 is a schematic view of a prior art gas turbine engine 20 that includes a compressor 22, fuel injectors positioned within a cap assembly 24, combustion chambers 26, transition ducts 28, a turbine 30, and a shaft 32 by which the turbine 30 drives the compressor 22. Several combustor assemblies 24, 26, 28 may be arranged in a circular array in a can-annular design known in the art. During operation, the compressor 22 intakes air 33 and provides a flow of compressed air 37 to the combustor inlets 23 via a diffuser 34 and a combustor plenum 36. The fuel injectors within cap assembly 24 mix fuel with the compressed air. This mixture burns in the combustion chamber 26 producing hot combustion gasses 38 that pass through the transition duct 28 to the turbine 30. The diffuser 34 and the plenum 36 may extend annularly about the shaft 32. The compressed airflow 37 in the combustor plenum 36 has higher pressure than the working gas 38 in the combustion chamber 26 and in the transition duct 28.

Figure 2:
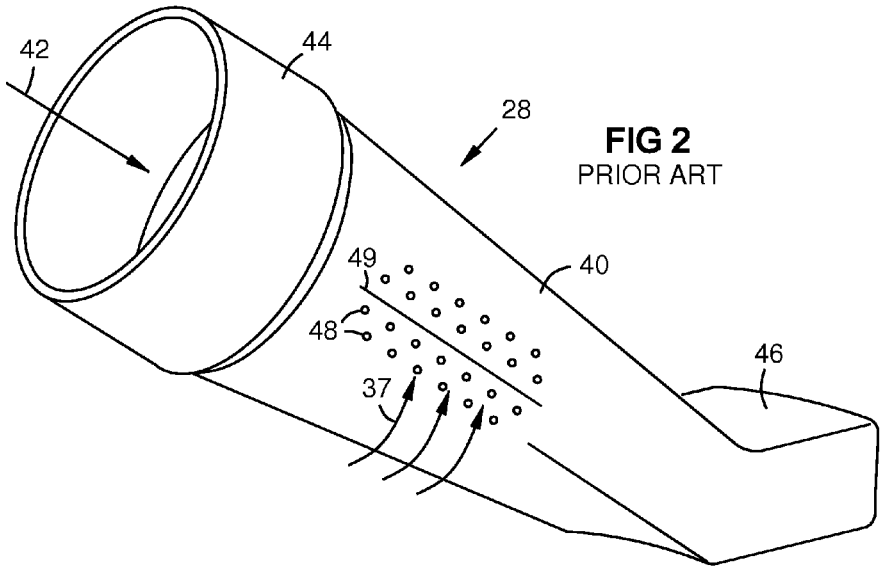
FIG 2 PRIOR ART
FIG. 2 is a perspective view of a prior art transition duct.
Figure 3:
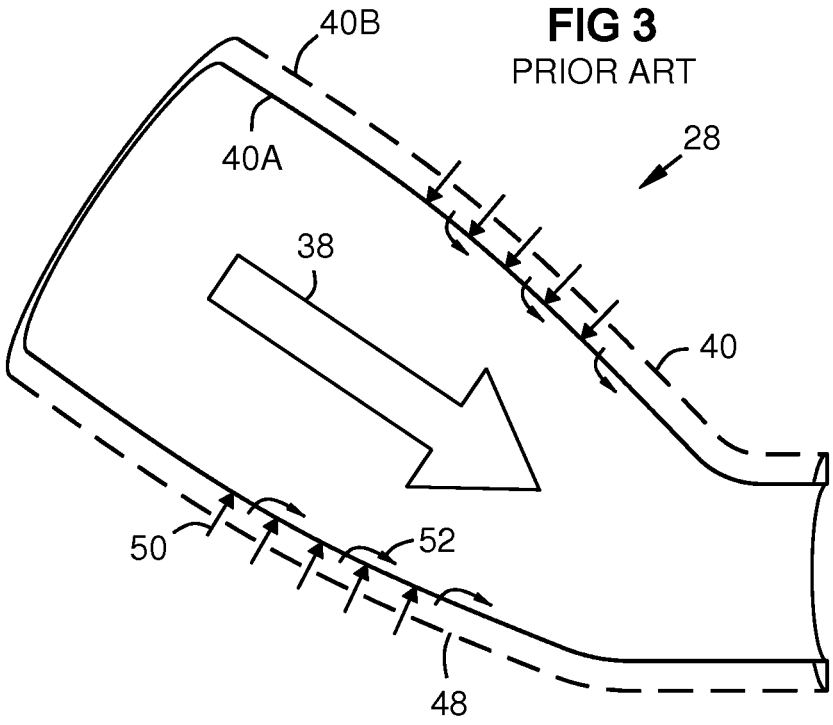
FIG 3 PRIOR ART
FIG. 3 is a schematic sectional view of a prior art double-walled transition duct.

FIG. 2 is a perspective view of a prior art transition duct 28 comprising a tubular enclosure with a wall 40 bounding a hot gas path 42. The upstream end 44 may be circular and the downstream end 46 may be generally rectangular with turbine-matching curvature as shown. FIG. 3 schematically shows a sectional side view of the duct 28 illustrating that the wall 40 includes an inner wall 40A and an outer wall 40B or sleeve. The outer wall 40B may be perforated with holes 48 that admit cooling air, which forms impingement jets 50 directed against the inner wall 40A. After impingement, the coolant may pass through film cooling holes 48 in the inner wall 40A for film cooling 52 as known in the art and/or it may flow to the combustion chamber. A similar double-wall construction may be used on the combustion chamber 26 and the invention may be applied there as well. FIG. 2 also illustrates a trip strip 49 as used in the art at a location proximate a region or line of maximum constriction of the flow 37 as it passes between the duct 28 and an adjacent duct. Upstream of the region of maximum constriction the flow 37 is constricting as it moves forward because the area between the adjacent ducts is decreasing. Downstream of the region of maximum constriction between adjacent transition ducts the flow 37 is diffusing and becomes locally unstable, thereby interfering with the effectiveness of the holes 48 in the unstable flow region. The trip strip 49 is used to ensure that separation of the flow 37 occurs at a desired location.

Although the compressed airflow 37 in the combustor plenum 36 has higher pressure than the working gas 38, it is beneficial to increase this differential to increase the velocity of the impingement jets 50. This has been done using an air scoop at each of at least some of the impingement holes 48. The scoops may redirect some of the coolant flow into the holes 48. They convert some of the coolant velocity pressure to static pressure at the holes 48, thus increasing the pressure differential.

Figure 4:
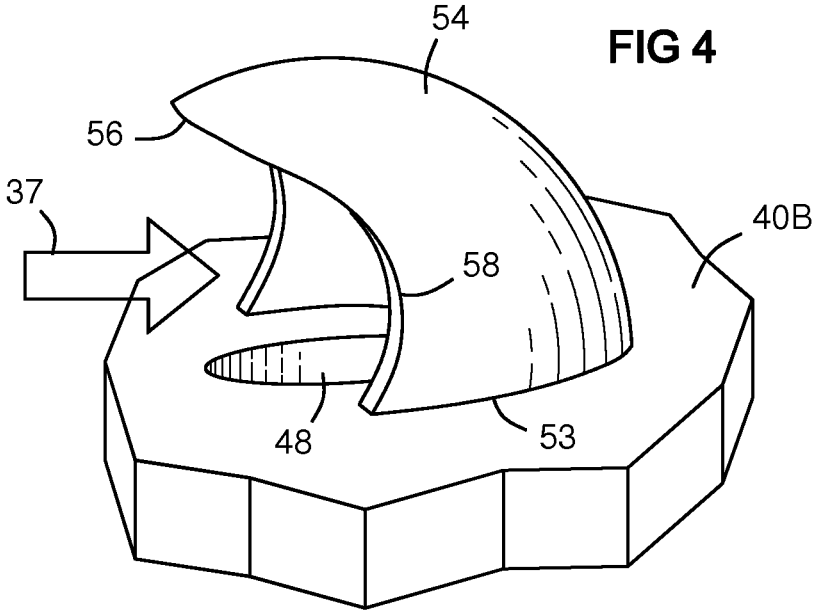
FIG. 4 is perspective view of an exemplary coolant scoop per aspects of the invention.

FIG. 4 shows an embodiment of an air scoop 54 per aspects of the invention. Scoop 54 may have a leading edge with a generally centralized forward projection or tongue 56 that overhangs the hole 48, and an undercut, such as curved undercut 58, on each side of the tongue between the tongue and a C-shaped or generally U-shaped attachment base 53. The leading edge shape of scoop 54 is thus streamlined for reduced aerodynamic friction and downstream turbulence. The scoop 54 may have a spherical geometry with an attachment base 53 along an equator thereof. Such geometry minimizes aerodynamic friction, especially wasted or collateral friction.

Figure 5:
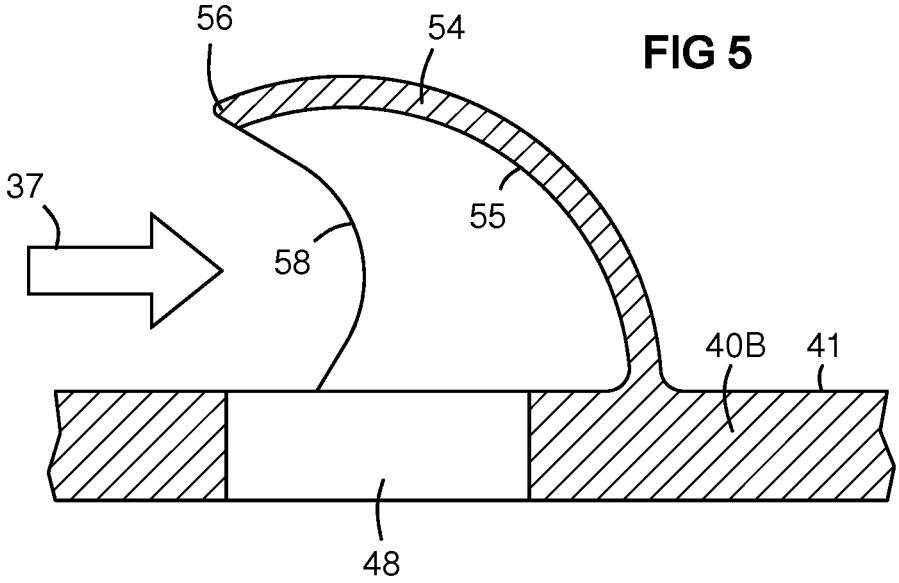
FIG. 5 is a sectional side view of the exemplary scoop of FIG. 4.
Figure 6:
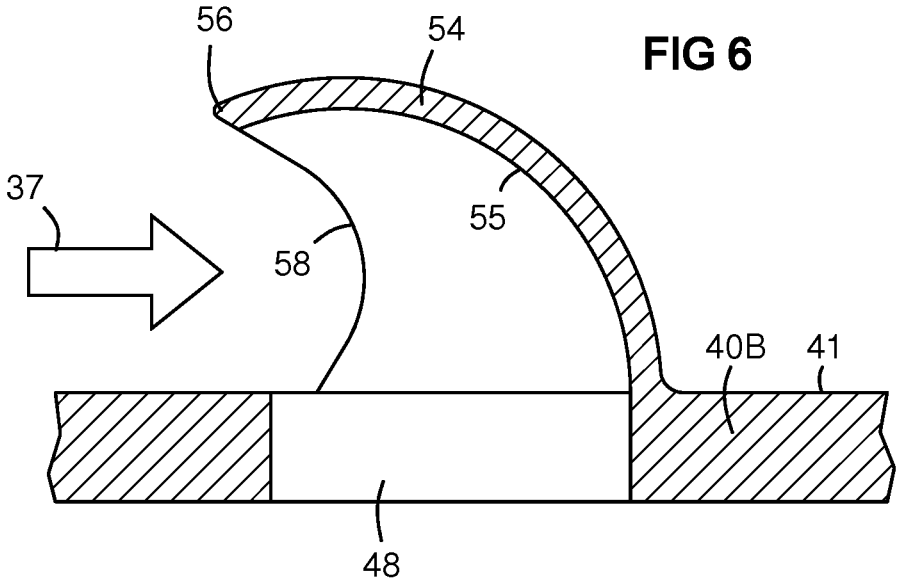
FIG. 6 is a sectional side view of an exemplary scoop with a different hole position.

FIG. 5 is a sectional view of FIG. 4. An outer surface 41 of the wall 40B and an inner surface 55 of the scoop 54 are indicated. The leading edge 56, 58, or at least the tongue 56, may taper to a sharp leading edge portion distally for streamlining. FIG. 6 is a sectional view of a scoop 54 similar to that of FIG. 4, showing a different hole size and position of the scoop 54 relative to the hole 48. The cooling scoop 54 design herein improves the ability to redirect airflow to be used for impingement characteristics of the combustion system. In this embodiment the attachment of the inner surface of the scoop 54 is smoothly aligned with a rearmost portion of the hole 48 at the attachment base, whereas in the embodiment of FIG. 5 the attachment base is positioned somewhat behind the rearmost portion of the hole.

Figure 7:
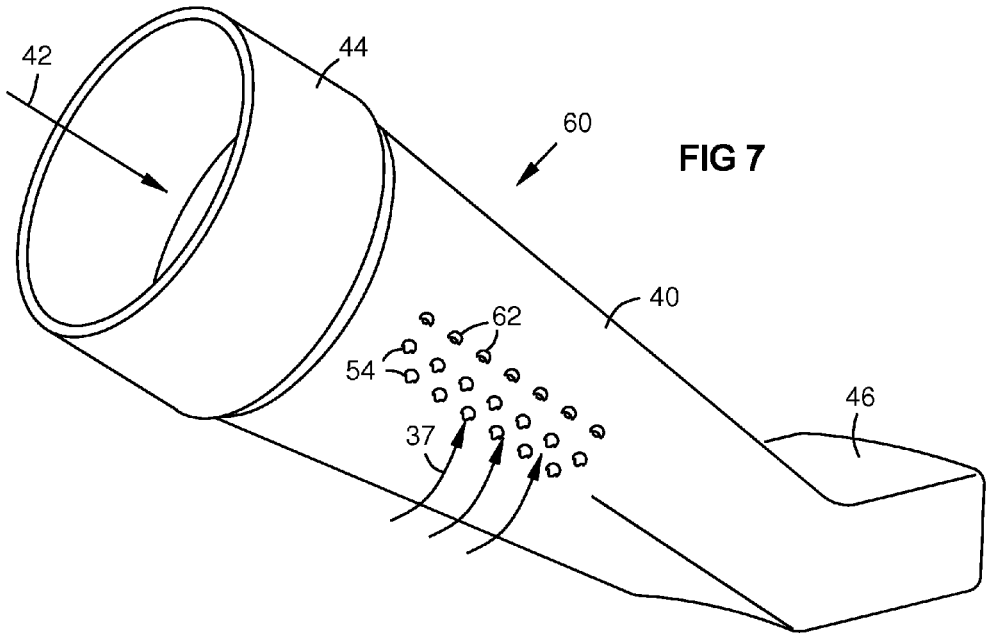
FIG. 7 is a perspective view of a transition duct in accordance with one embodiment of the invention.
Figure 8:
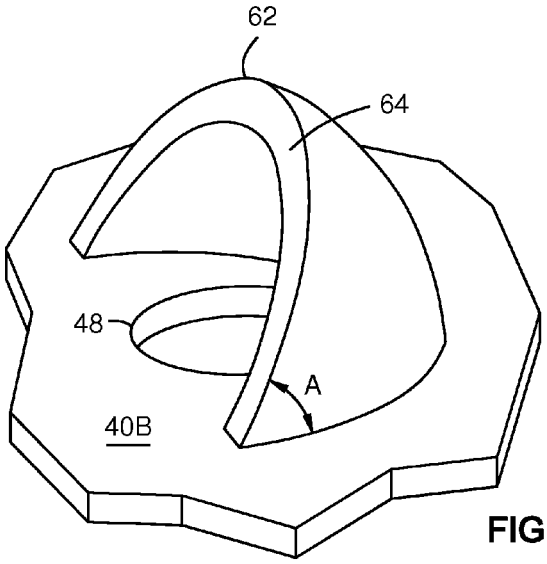
FIG. 8 is a perspective view of a partial scoop.

FIG. 7 is a perspective illustration of a transition duct 60 including a plurality of scoops 54 such as illustrated in FIGS. 5 and 6. In addition, the duct 60 includes a plurality of partial scoops 62. The term "partial scoop" is further illustrated in FIG. 8, which is a closer perspective view of a single partial scoop 62 disposed around a single impingement hole 48. Note that the partial scoop 62 includes a generally planar leading edge 64 lying in a plane that forms an acute angle A (less than 90 degrees) with a plane representing the local surface of the duct wall 40B (recognizing that the local surface may have a slight curvature). In the embodiment of FIG. 7, the partial scoops 62 are disposed at locations downstream of the region of maximum constriction between adjacent transition ducts (i.e. the line where a prior art trip strip would otherwise be located). The combination of scoops 54 upstream of the region of maximum constriction and partial scoops 62 downstream of that region has been found to provide adequate cooling without the need for trip strips.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A cooling apparatus that redirects a coolant fluid, comprising;

a transition duct wall disposed in a coolant flow in a can-annular gas turbine engine;

a plurality of scoops disposed over a respective plurality of coolant inlet holes formed in the transition duct wall at locations upstream of a region defining a minimum distance between the transition duct wall and an adjacent transition duct wall, each scoop comprising a leading edge with a central projection that overhangs the respective coolant inlet hole and an undercut on each side of the central projection between the central projection and a base of the scoop attached to the transition duct wall; and a plurality of partial scoops disposed over a respective plurality of coolant inlet holes formed in the transition duct wall at locations downstream of the region defining the minimum distance between the transition duct wall and the adjacent transition duct wall, each partial scoop comprising a generally planar leading edge lying in a plane leaning rearward from a leading end of the attachment base to form an acute angle with a plane of the transition duct wall proximate the respective coolant inlet hole.

* * * * *